US007775521B1

(12) United States Patent
Itkis et al.

(10) Patent No.: US 7,775,521 B1
(45) Date of Patent: Aug. 17, 2010

(54) SMART BALL BLOWER

(75) Inventors: Yuri Itkis, Las Vegas, NV (US); Horia Mihai Preda, Las Vegas, NV (US); Ioan M. Puscas, Las Vegas, NV (US)

(73) Assignee: FortuNet, Inc., Las Vegas, NV (US)

( * ) Notice: Subject to any disclaimer, the term of this patent is extended or adjusted under 35 U.S.C. 154(b) by 168 days.

(21) Appl. No.: 12/043,086

(22) Filed: Mar. 5, 2008

Related U.S. Application Data

(60) Provisional application No. 60/893,035, filed on Mar. 5, 2007.

(51) Int. Cl.
*A63F 3/06* (2006.01)
*A63F 7/40* (2006.01)

(52) U.S. Cl. ..... 273/144 B; 273/144 R; 463/22

(58) Field of Classification Search ..... 273/144 R, 273/144 A, 144 B; 463/22
See application file for complete search history.

(56) References Cited

U.S. PATENT DOCUMENTS 5,590,879 A 1/1997 Tripp
5,799,940 A 9/1998 Tripp
6,120,024 A * 9/2000 Lind ..... 273/144 R
2007/0108700 A1 * 5/2007 Bigelow ..... 273/138.1

* cited by examiner

*Primary Examiner*—Benjamin H Layno
(74) *Attorney, Agent, or Firm*—Greenberg Traurig

(57) ABSTRACT

Disclosed is a ball blower apparatus for facilitating games of chance. The ball blower apparatus has a motor-driven ball carriage mechanism that captures air-ejected balls from a ball mixing chamber and carries the captured ball to an inlet of a ball return tube that extends downward to a bottom of the ball mixing chamber. Captured balls travel down the tube under air pressure generated by an air blower. The air pressure also prevents the balls from electro-statically clinging to walls of the tube. The balls may be bar-coded and scanned by a bar-code reader while being handled by the ball carriage mechanism. A computer interfaced with the barcode reader automatically controls the operation of the ball blower including the operation of the carriage motor, air blower(s) and a solenoid that controls the egress of balls from the ball return tube into the mixing chamber. A TV camera may also be utilized to capture and visually display numbers associated with the balls.

22 Claims, 8 Drawing Sheets

SMART BALL BLOWER

CROSS-REFERENCE TO RELATED APPLICATION

This application claims the benefit of U.S. Provisional Patent Application No. 60/893,035 filed on Mar. 5, 2007.

FIELD OF THE INVENTION

The embodiments of the present invention relate to gaming systems, more specifically, the embodiments relate to ball blowers operable as random number generators.

BACKGROUND

Automatic ball blowers, such as described in industry publications and disclosed in U.S. Pat. Nos. 5,590,879 and 5,799,940 (both to Tripp) are widely used in the gaming industry to generate random numbers for keno, bingo and lottery type games. Although automatic ball blowers yield labor savings and significantly contribute to the integrity and security of the gaming process, they are generally quite expensive, unreliable, bulky, slow and limited in their ball capacity.

Accordingly, there is a need to provide an inexpensive, reliable, compact and quick ball blower with improved ball capacity.

SUMMARY

Accordingly a first embodiment of the present invention is a ball blower apparatus comprising: a ball mixing chamber operable to house a plurality of balls; and at least one air blower means coupled to the ball mixing chamber, the at least one air blower means operable to generate air pressure to mix the plurality of balls within the ball mixing chamber and further drive one or more randomly captured balls back into the mixing chamber.

The embodiments of the present invention achieve the desired objectives by providing a motor-driven ball carriage mechanism that captures each air-ejected ball from a ball mixing chamber and carries the captured ball to an inlet of a ball return tube that spirals downward, and in one embodiment, around a ball mixing chamber, to a bottom of the ball mixing chamber. Captured balls travel down the tube under air pressure generated by an air blower. The air pressure also prevents the balls from electro-statically clinging to the walls of the tube. In one embodiment, the balls are bar-coded and scanned by a barcode reader or scanner while being handled by the ball carriage mechanism. A computer interfaced with the barcode scanner (and with a TV camera focused on the ejected balls) automatically controls the operation of the ball blower apparatus including the operation of the carriage motor, air blower(s) and the solenoid that controls the egress of balls from the tube back into the mixing chamber.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
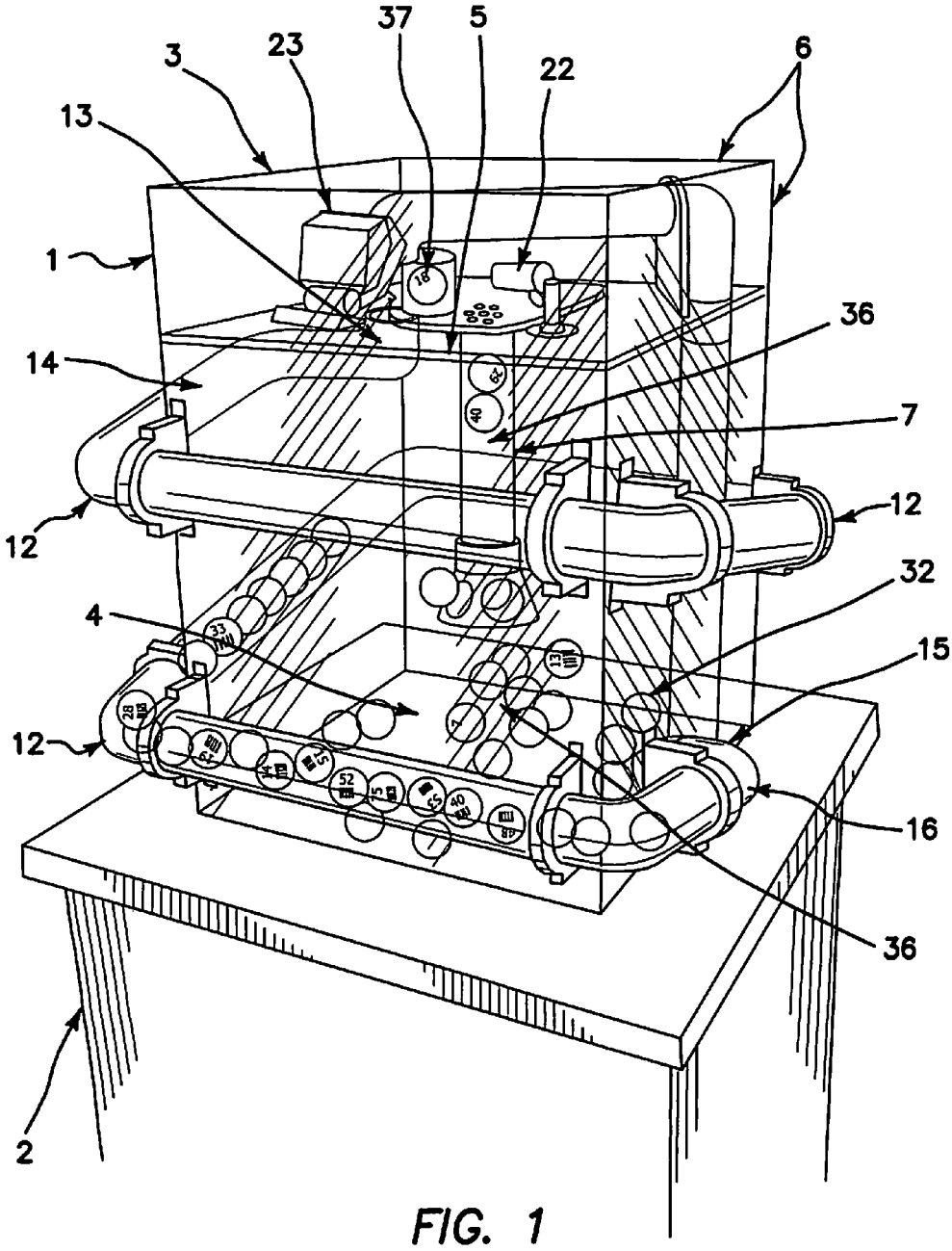
FIG. 1 illustrates a perspective view of an embodiment of the smart ball blower.

Initial reference is made to FIG. 1 showing an automatic ball blower having a ball mixing chamber 1 positioned on a support stand 2. In one embodiment, the mixing chamber 1 is fabricated of Plexiglas (or any suitable material) in the form of an inverted vertical hollow rectangular prism 3 finished by or glued to a pyramid 4, which can also be fabricated of Plexiglas (or any suitable material). As shown, the mixing chamber 1 is mounted upside down on the support stand 2. The upper portion of the mixing chamber 1 houses a horizontal support plate 5 that can be attached to the walls 6 of the mixing chamber 1 using screws and small mounting brackets or other suitable means. Like the mixing chamber 1, the support plate 5 is fabricated of Plexiglas (or any suitable material). Although the Plexiglas for the mixing chamber 1 and the support plate 5 is transparent as shown, it is understood that the Plexiglas can be partially transparent or opaque.

Figure 2:
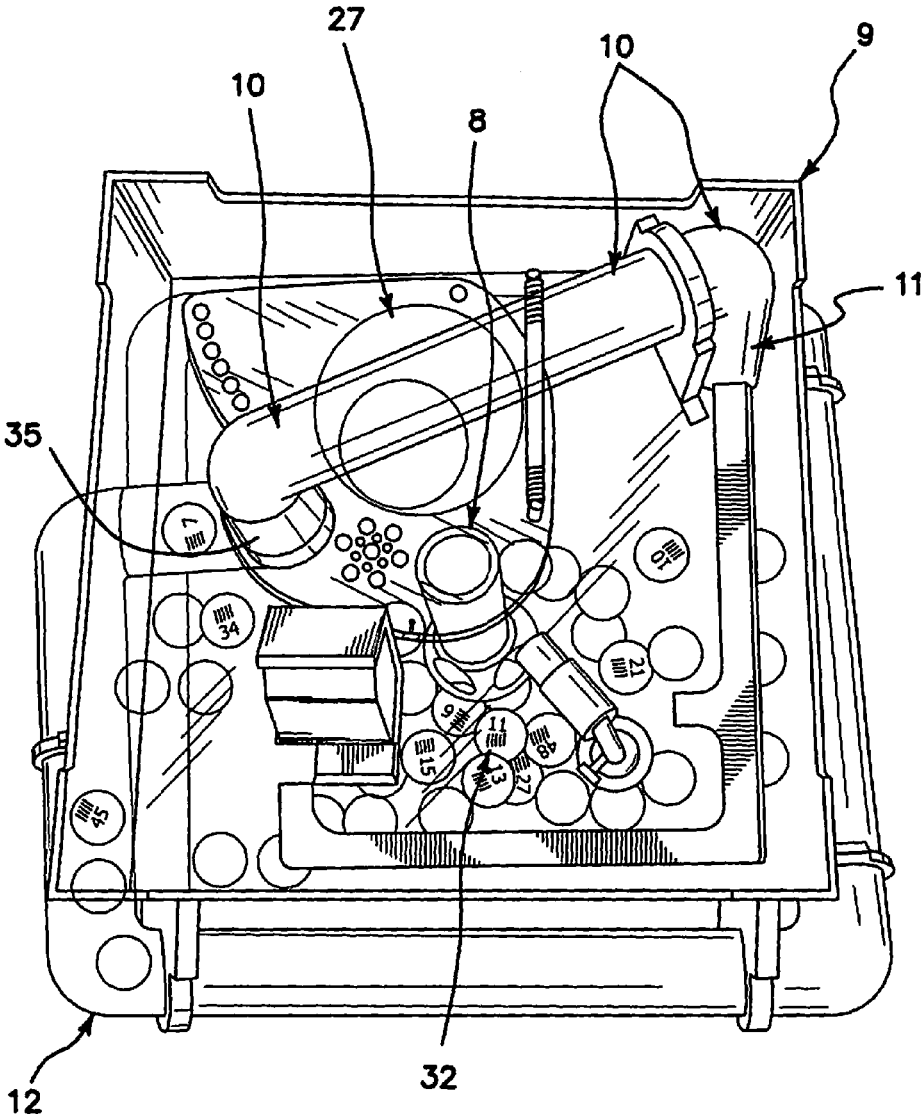
FIG. 2 illustrates an upper view of an embodiment of a smart ball blower.

Inside the mixing chamber 1 is a central ball ejection tube 7 attached to the support plate 5 through an opening 8 in the center of the support plate 5 as best shown in FIG. 2. Also inside the mixing chamber 1, near a corner 9, is a reverse U-shaped auxiliary tube 10 that pierces through the support plate 5 at a circular opening 11. Like the mixing chamber 1, the ejection tube 7 and the auxiliary tube 10 can be fabricated of Plexiglas or other suitable materials.

A spiraling ball return tube 12 circumscribes the exterior surface of the mixing chamber 1. Although the return tube 12 is shown as a circular transparent tube positioned external to ball mixing chamber 1, the return tube 12 can also be implemented as a triangular or rectangular metal or any other cross-sectional shaped air duct on the exterior or interior surfaces of the mixing chamber 1. In addition, like the mixing chamber 1, the return tube 12 is fabricated of Plexiglas (or any suitable material) and can be completely or partially transparent.

Figure 3:
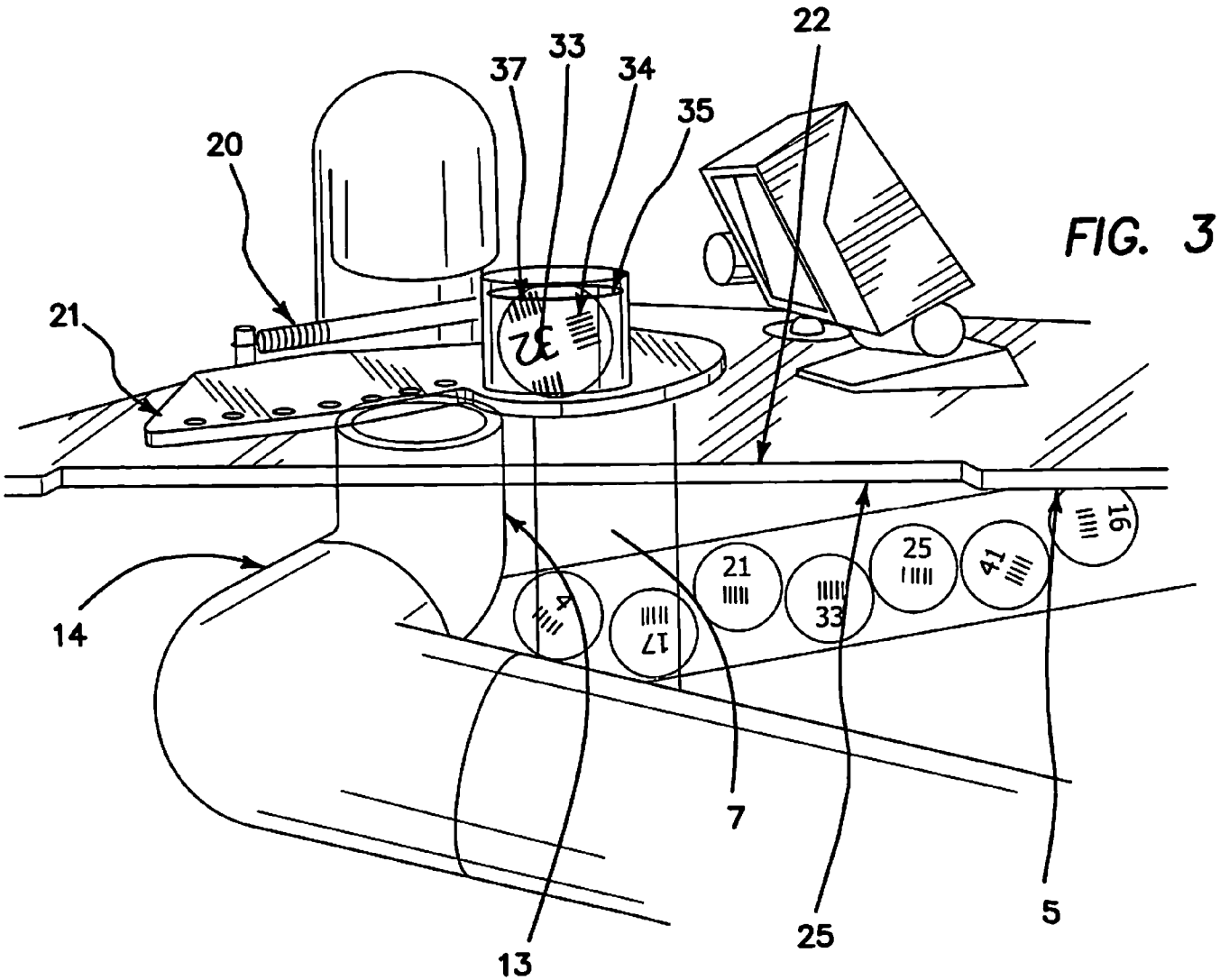
FIG. 3 illustrates a side view of a ball carriage mechanism.
Figure 5:
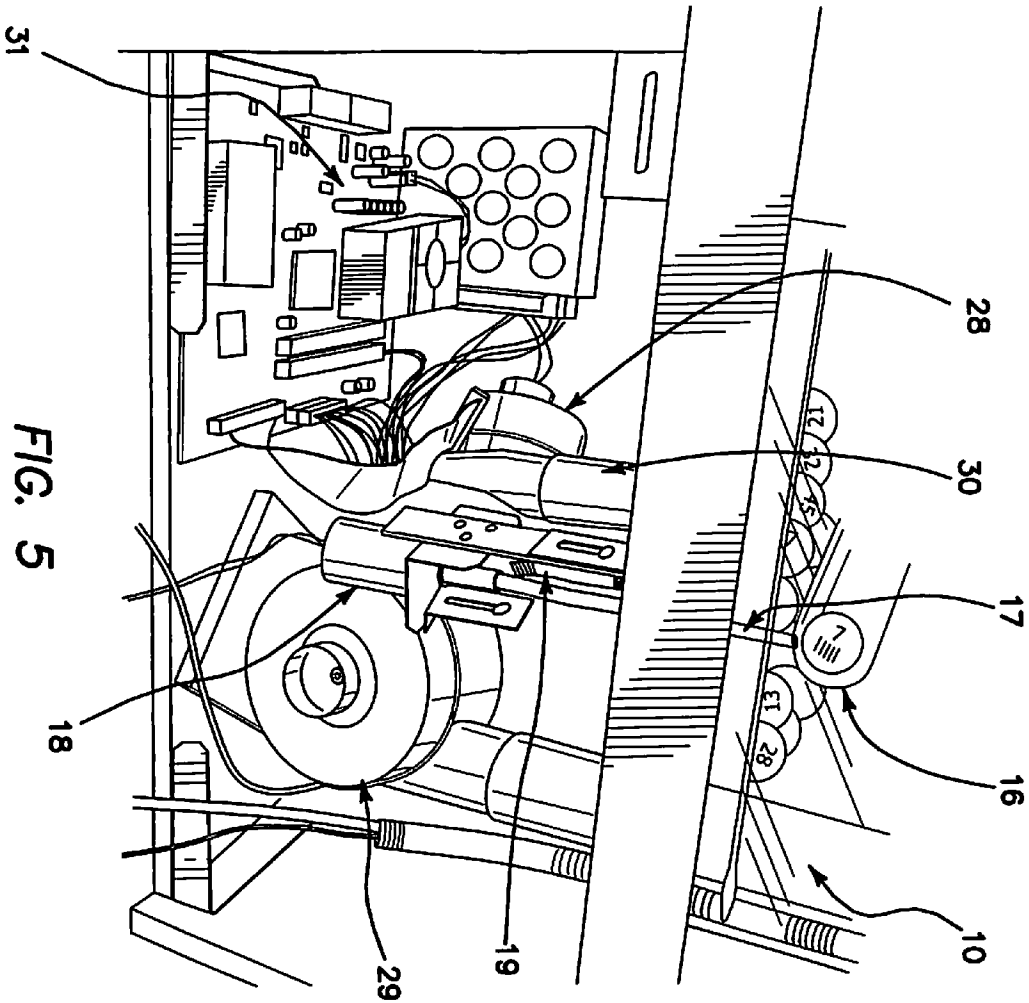
FIG. 5 illustrates a perspective view of a support stand with an access door in an open position.

An inlet 13 of the return tube 12 can be located inside the mixing chamber 1 under the support plate 5 as shown in FIG. 3. The body of the return tube 12 penetrates one of the walls 6 of the mixing chamber 1 at an upper point 14, curves around the exterior of the other walls 6 of the mixing chamber 1, and re-enters the mixing chamber 1 through an opening 15 located at a lower point of the mixing chamber 1. As best shown in FIG. 5, the bottom end of the return tube 12 forms a ball outlet 16 gated by a pull-in slidable and/or extendable metal or Plexiglas shaft 17 controlled by a solenoid 18. Biased by a spring 19, the shaft 17 normally closes, at least partially, the outlet 16.

Figure 4:
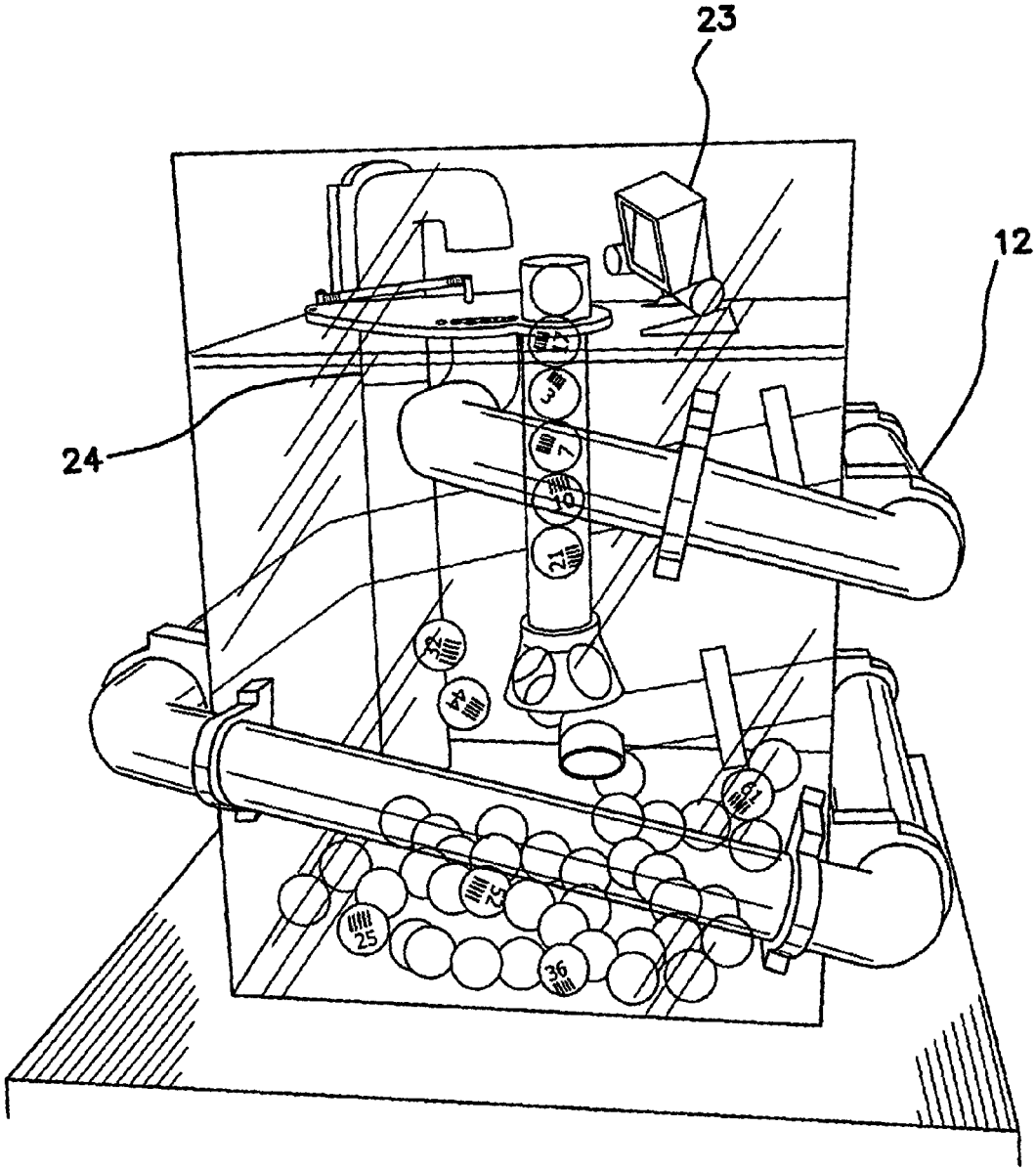
FIG. 4 illustrates a side view of an embodiment of a smart ball blower.
Figure 8:
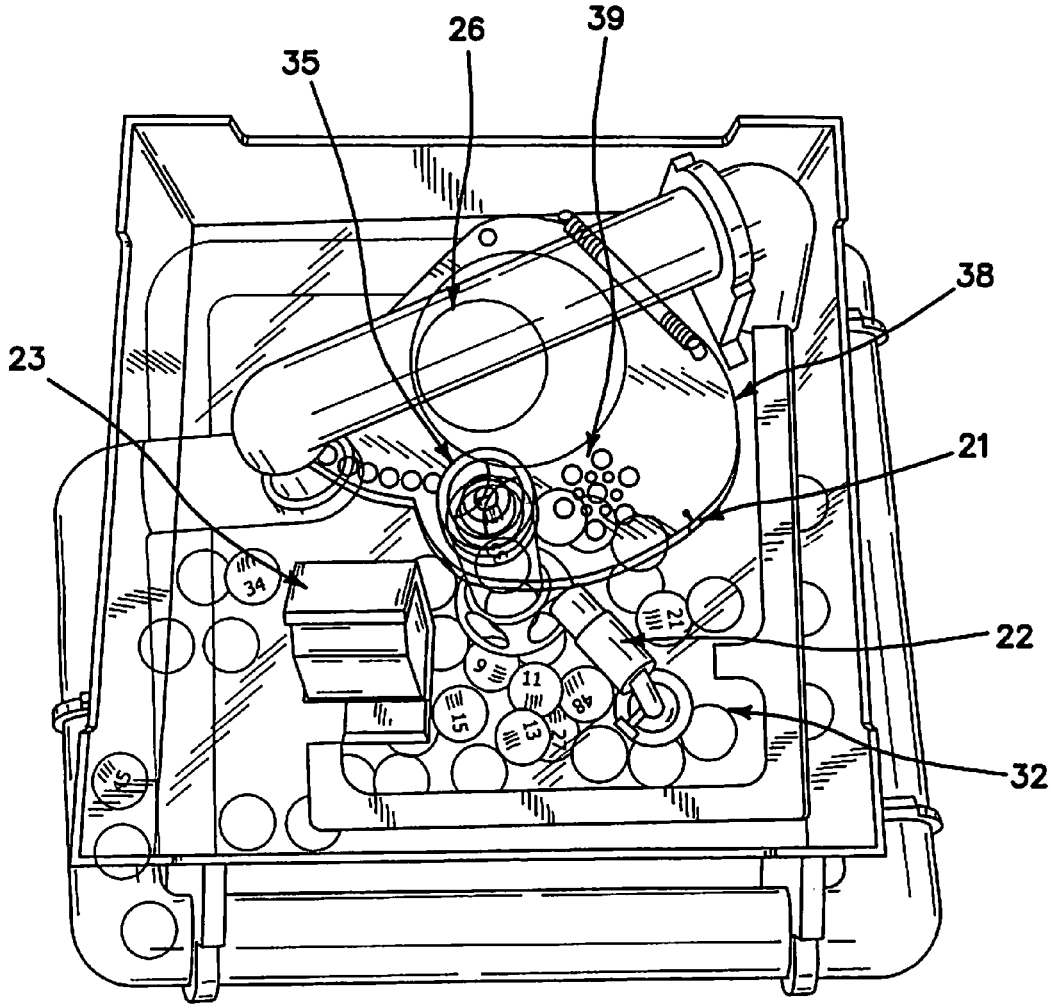
FIG. 8 illustrates an upper view of an embodiment of a smart ball blower with a ball positioned such that the number thereon is exposed to a TV camera.

Referring again to FIG. 3, the support plate 5 supports a spring-loaded (by spring 20) ball carriage mechanism 21 slidably mounted on the top surface 22 of the support plate 5. A digital TV camera 22 and barcode reader or scanner 23 is mounted adjacent thereto on the top surface 22 of the support plate 5. In one embodiment, the barcode scanner 23 is omni-directional. A stepper motor 24 (see FIG. 4), having a circular frictional gear disc 26 securely mounted on the shaft of the motor 24 (see FIG. 8), is mounted on the bottom surface 25 of the support plate 5. The gear 26 frictionally engages an inner surface of a camera opening 27 in the carriage 21 as shown in FIG. 2.

Referring now to FIG. 5, the support stand 2 is fabricated of wood or other rigid material and is configured to house two air blowers, namely, a main air blower 28 and an auxiliary air blower 29. However, the support stand 2 can also be fabricated to house more or fewer than two air blowers 28, 29. The main air blower 28 is attached to the mixing chamber 1 at a bottom opening via a manifold 30 while the auxiliary air blower 29 is attached to a bottom inlet of the reverse U-shaped auxiliary tube 10.

In addition to the two air blowers 28, 29, the support stand 2 is also configured to house a processor or computer 31 (e.g., personal computer) and other electronic components (not shown). The computer 31 is programmed to electronically control the air blowers 28, 29, the TV camera 22, the barcode reader or scanner 23, the stepper motor 24 and/or the solenoid 18. Optionally, the computer 31 may communicate with a reflective photo-interrupter (not shown).

The mixing chamber 1 houses a plurality of plastic balls 32, e.g., seventy-five bingo balls 32. Each of the plastic balls 32 can be individually marked or imprinted with a unique ball number 33 and a unique barcode 34 corresponding to the ball number 32 as best shown in FIG. 3. In one embodiment the balls 32 are hollow (i.e., filled with air).

In one embodiment as described above, a majority of operations of the automatic ball blower are controlled by the computer 31. Before a round of game (e.g., bingo) begins, the computer 31 deactivates both the main blower 28 and the auxiliary blower 29 as well as the solenoid 18 and the stepper motor 24. As a result, the spring loaded shaft 17 of the solenoid 18 returns to its normal closed (extended) position and the spring loaded carriage 21 returns to its default position in which the ball capture cup 35 of the ball carriage 21 is positioned over the outlet (top opening) of the ejecting tube 7.

Figure 6:
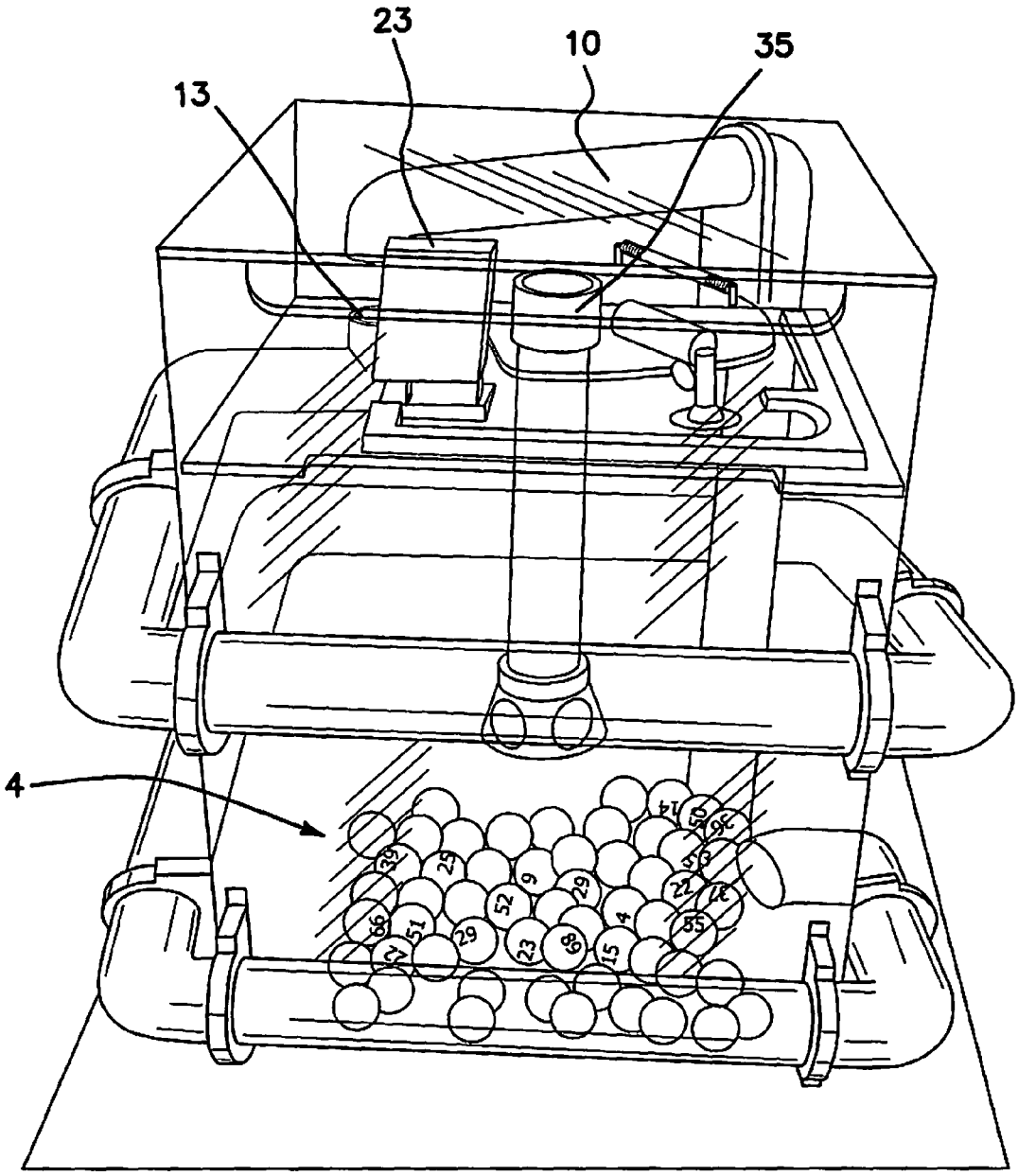
FIG. 6 illustrates a perspective view of an embodiment of a smart ball blower prior to it being activated.

As a result of the blowers 28, 29 being deactivated or switched off, each of the plastic balls 32 within the mixing chamber 1 rest at the bottom of the mixing chamber 1 and tend to congregate near the center of the inverted pyramid 4 as best shown in FIG. 6. When the game begins, the computer 31 activates both the main blower 28 and the auxiliary blower 29. The main blower 28 generates an air stream 36 directed through the air inlet opening at the bottom of the inverted pyramid 4 (see FIG. 1). The air stream 36 suspends and randomly mixes the plastic balls 32 and at some point in time, randomly ejects a ball 37 into the ejecting tube 7 in a manner well-known in the industry.

Figure 7:
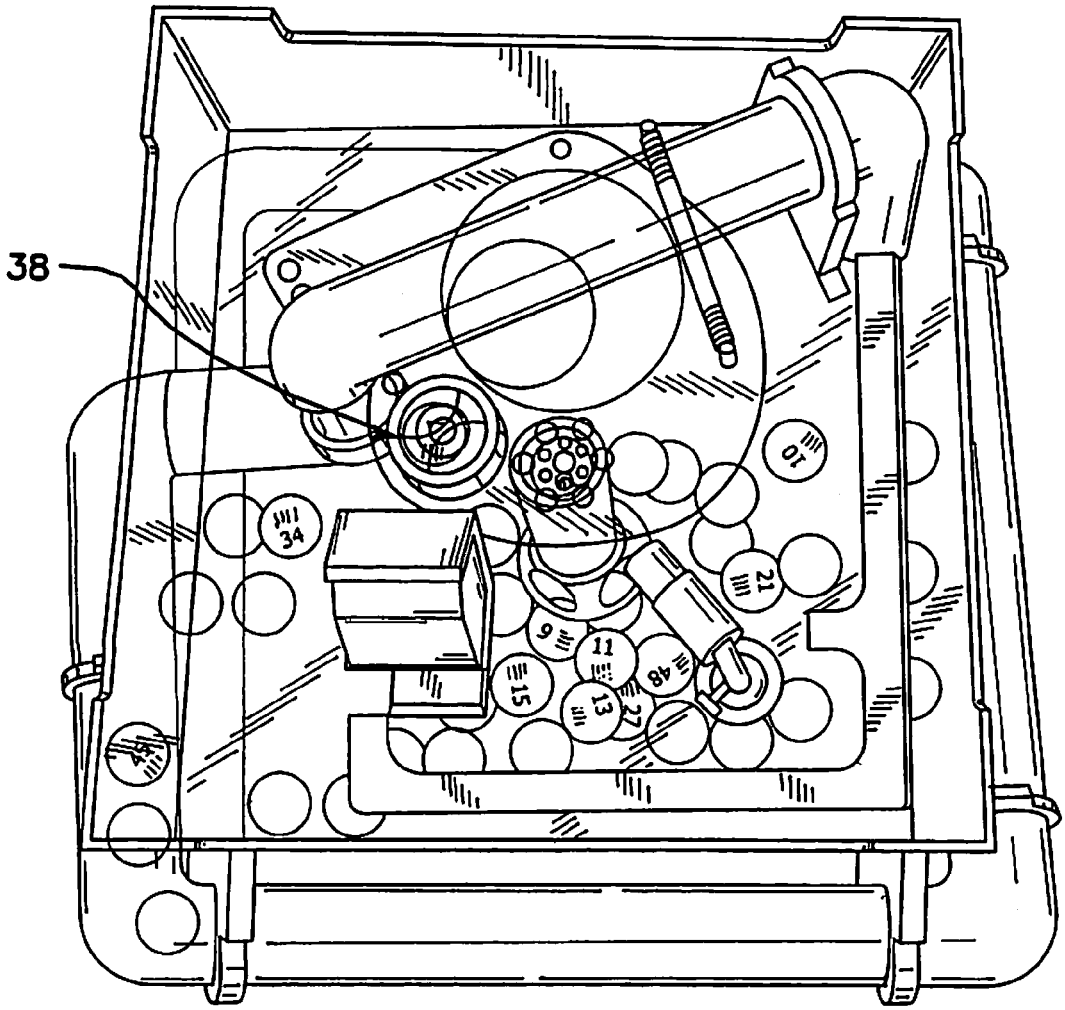
FIG. 7 illustrates an upper view of an embodiment of a smart ball blower with a ball positioned such that it can be scanned by a barcode scanner.

The randomly-ejected ball 37 travels to a cup 35 having a mesh cover top 38 (see FIGS. 3 and 7). While the mesh 38 allows the air stream 36 to vent through the cup 35, it also prevents the randomly ejected ball 37 from escaping from the cup 35. Once the randomly-ejected ball 37 is captured inside the cup 35, its image is processed by the TV camera 22 and relayed to the computer 31 for optional display on TVs or plasma displays located in a gaming establishment (not shown). Also, once the randomly-ejected ball 37 is captured in the cup 35, it can be detected by an optional reflective photo-interrupter or other sensor (not shown) that signals the ball capture event to the computer 31.

Once the ball 37 is captured by the cup 35, the stepper motor 24 rotates the gear disk 26 clockwise (or counterclockwise) thereby causing the carriage mechanism 21 to rotate clockwise (or counterclockwise) by virtue of the frictional engagement between the gear disk 26 and the internal camera opening 27 of the carriage mechanism 21. It is understood that the gear disk 26 and the carriage mechanism 21 can also be rotatably engaged by other suitable means. As a result, the ball 37 captured in the cup 35 of the carriage mechanism 21 is moved through the field of view of the barcode reader or scanner 23. Accordingly, as the ball 37 moves through the field of view of the barcode reader or scanner 23, the scanner 23 captures the barcode 34 and, based thereon, sends the scanned identification number 33 of the ball 37 to the computer 31.

Once the computer 31 receives the ball identification number 33, the stepper motor 24 moves the carriage 21 along with the captured ball 37 further clockwise (or counterclockwise) to a position directly between the inlet 13 of the ball return tube 12 and the outlet of the reversed U-shaped auxiliary tube 10. In this position, under the combined forces of gravity and pressure of the air stream 36 being blown through the auxiliary tube 10 by the auxiliary blower 29, the ball 37 drops from the cup 35 into the inlet 13 of the ball return tube 12 and travels down the tube 12 towards the outlet 16, which at this point in time, is blocked by the closed shaft 17 of the solenoid 18.

Subsequently, the stepper motor 24 returns the ball carriage 21 to its original position wherein the cup 35 is again located directly above the outlet of the central ball ejecting tube 7. From there on, the above-described process of extracting balls 37 from the ball mixing chamber 1, moving the ball 37 through a field of view by the carriage 21, and dropping the ball 37 into the ball return tube 12 under the combined forces of gravity and air stream 36 is repeated for every new ball 37 until the game concludes, e.g., until twenty balls 32 are extracted from the mixing chamber 1 during a conventional keno game. Each of the balls 32 which are extracted subsequently accumulate at one end 16 of the tube 12 under gravity and pressure of the auxiliary air stream 36 generated by the auxiliary blower 29 as best shown in FIG. 1.

Once the game concludes, the computer 31 commands the main air blower 28 to switch off and the solenoid 18 to pull-in the shaft 17 thereby allowing the balls 32 accumulated in the tube 12 to return to the mixing chamber 1 under the pressure of the auxiliary air stream. Once each of the balls 32 are fully ejected from the tube 12 back into the mixing chamber 1 (as may optionally be detected by a second reflective photo-interrupter), the computer 31 restarts the main blower 28 and repeats the above-described process for the next game.

Note that the auxiliary air stream generated by the auxiliary air blower 29 greatly facilitates the process of rolling the balls 32 down the tube 12. Without the auxiliary air stream, balls 32 may tend to cling to the walls of the tube 12 because of electrostatic forces, and gravity alone may not be sufficient to cause the balls 32 to roll into the ball mixing chamber 1 unless the incline of the tube 12 is very steep thereby enlarging the overall size of the smart ball blower. The auxiliary air stream also alleviates the tendency of the balls 32 to electrostatically collect together at the bottom of the mixing chamber 1 at the beginning of the game.

Note also that the tube 12 accumulates each of the balls 32 ejected from the ball ejection tube 7 during the current round of the game and preserves the order in which the balls 32 were ejected, i.e., preserves the history of the game. Since the tube 12 is preferably transparent, the history of the game can be easily ascertained by reviewing the balls 32 contained within the tube 12.

The present invention exemplified by the embodiments described above can be implemented in many other ways without departing from its main principles. In particular, the auxiliary air blower 29 does not necessarily have to be mounted on the inside of the support stand 2 and may, for example, be implemented as a simple fan mounted directly on the top of the support plate 5. Although two separate air blowers 28, 29 are described above, only one such device may be sufficient to generate both the main and auxiliary air streams using a Y-shaped manifold for splitting the air from a single air blower. Moreover, the Y-shaped manifold may be embedded with control valves to allow for separate controls of each of the air streams.

Also, the stepper motor 24 may be implemented as a reversible stepper motor allowing the computer 31 to move the carriage mechanism 21 back and forth in front of the barcode reader or scanner 23 as needed to facilitate scanning the ball barcode 34 or ball number 33. If the barcode 34 cannot be read even after a predetermined number of back and forth oscillations of the carriage mechanism 21 in front of the reader or scanner 23, the computer 31 signals an error condition and stops the game while awaiting human intervention.

The carriage 21 may also incorporate a wing 38 that covers the outlet of the central ball ejecting tube 7 when the cup 35 is positioned directly above the inlet 13 of the ball tube 12. By closing the outlet of the central ball ejecting tube 7, the wing 38 causes air pressure inside of the tube 7 to build-up and as a result, any balls 32 that may be inside of the tube 7 at the time may drop back into the mixing chamber 1. The wing 38 also has the ability to prevent the undesirable effect of several balls 32 accumulating inside the ball ejection tube 7. Since the mixing chamber 1 and the ejection tube 7 are preferably transparent, players can view the contents of the ejection tube 7, i.e., know in advance the ball that is about to be ejected from the tube 7 unless such ball is dropped back into the mixing chamber 1. Also, the carriage 21 may have perforations 39 which increase the speed of ejection of the next ball 37 into the tube 7 while the cup 35 moves back from the position above the inlet 13 of the return tube 12 into the position directly above the ball ejection tube 7.

Although the air mixing chamber 1 as shown in FIG. 1 is a rectangular prism 3, the air chamber 1 may also be implemented as a circular or semicircular prism or any polygonal forms and shapes. Similarly, the ball return tube 12 does not necessarily have to be implemented as a descending staircase 12. It may, for example, be implemented as a down-spiraling pipe leading from the top to the bottom of the air mixing chamber 1. Moreover, the ball return tube 12 does not necessarily have to extend around the ball mixing chamber 1 on the exterior surface but may instead be totally enclosed within the interior surface of the ball mixing chamber 1.

Note that the overall length of the ball return tube 12 can be varied to accommodate a specific number of balls required to be drawn from a particular game. For example, in a British-style bingo game, the ball return tube 12 has to be able to accommodate up to ninety balls while seventy-five balls are drawn for an American-style bingo game, twenty balls are drawn for a keno game and six balls are drawn for a typical lottery game.

Further, a co-pending application to the same assignee discloses event ticket games, only a single ball 37 is required to determine an outcome of the game. In such a game, as soon as the ejected ball 37 is read by the barcode scanner 23, the ball 37 may be immediately returned to the ball mixing chamber 1. For this type of application, the ball return tube 12 may not even be necessary or may be very short and simply constitute a U-shaped extension of the central ball ejection tube 7, while the function of the carriage 21 may be performed by a solenoid 18 that temporarily arrests the ejected ball 37 in order to facilitate reading of the barcode 34 by the reader or scanner 23 and the capturing of the video image of the ball 37 by the TV camera 22. Note that such a simplified embodiment also eliminates the need for the auxiliary air blower 29 and the auxiliary air tube 10 as well.

Having a built-in Ethernet adapter, the smart ball blower may be utilized either as a free-standing ball blower installed in a bingo room or in tandem with another similar ball blower (having a different Internet Protocol address) to form a bingo caller desk with one smart ball blower being utilized for calling regular session bingo games while the other smart ball blower may be utilized for calling special bingo games such as bonanza bingo games. Note also that while the computer 31 is fully capable of automatically controlling the random number generation process, in some environments, e.g., a typical bingo hall, the bingo caller may manually control at least some operations of the ball mixer by inputting respective commands into the computer 31 via a keyboard, mouse or touch screen.

Although the invention has been described in detail with reference to several embodiments, additional variations and modifications exist within the scope and spirit of the invention as described and defined in the following claims.

We claim:

1. A ball blower apparatus comprising:

a ball mixing chamber operable to house a plurality of balls;

a ball return tube;

one or more air blower means coupled to the ball mixing chamber, the one or more air blower means operable to generate moving air to mix the plurality of balls within the ball mixing chamber and further drive one or more balls from the ball mixing chamber into a ball container where the ball is captured at a first position external to said ball mixing chamber; and a movement mechanism configured to move the ball container from said first position to a second position aligning said ball container with said ball return tube allowing said one or more air blower means to force said captured ball into said ball return tube and move said ball eventually back into the mixing chamber.

2. The ball blower apparatus of claim 1, wherein said ball return tube is coupled to the ball mixing chamber, the ball return tube operable to receive one or more of the balls from within the ball mixing chamber via the ball container.

3. The ball blower apparatus of claim 1, wherein said ball return tube is coupled to the ball mixing chamber, the ball return tube operable to discharge the one or more randomly captured balls back into the ball mixing chamber.

4. The ball blower apparatus of claim 3, further comprising a movable member positioned at an end of said ball return tube operatively controllable to first prevent captured balls from returning to said ball mixing chamber and second to permit said captured balls to return to said ball mixing chamber.

5. The ball blower apparatus of claim 1, wherein said ball return tube circumscribes the ball mixing chamber.

6. The ball blower apparatus of claim 1, further comprising a computer programmed to control the operations thereof.

7. The ball blower apparatus of claim 1, further comprising two air blowers wherein a first air blower is operable to mix balls in the ball mixing chamber and a second air blower is operable to force captured balls through a ball return tube.

8. The ball blower apparatus of claim 1, further comprising one air blower having two outputs wherein a first output is operable to mix balls in the ball mixing chamber and a second output is operable to force captured balls through a ball return tube.

9. The ball blower apparatus of claim 1, wherein a bottom surface of the ball mixing chamber is shaped in a form of an inverted pyramid.

10. A ball blower apparatus comprising:

a ball mixing chamber operable to house a plurality of balls;

one or more air blowers coupled to the ball mixing chamber, the one or more air blowers operable to generate moving air to mix the plurality of balls within the ball mixing chamber and further drive one or more balls from the ball mixing chamber into a ball container where the ball is captured at a first position external to said ball mixing chamber; and a ball container movement device configured to move the ball container from said first position to a second position in alignment with a ball return tube such that said one or more air blowers may force said captured ball from said ball container into said ball return tube, said ball return tube in physical communication with said ball mixing chamber allowing said ball to move back into the mixing chamber.

11. The ball blower apparatus of claim 10, further comprising a movable member positioned at an end of said ball return tube operatively controllable to first prevent captured balls from returning to said ball mixing chamber and second to permit said captured balls to return to said ball mixing chamber.

12. The ball blower apparatus of claim 10, further comprising two air blowers wherein a first air blower is operable to mix balls in the ball mixing chamber and a second air blower is operable to force captured balls through a ball return tube.

13. The ball blower apparatus of claim 10, further comprising one air blower having two outputs wherein a first output is operable to mix balls in the ball mixing chamber and a second output is operable to force captured balls through a ball return tube.

14. The ball blower apparatus of claim 10, wherein a bottom surface of the ball mixing chamber is shaped in a form of an inverted pyramid.

15. A ball blower apparatus comprising:

a ball mixing chamber operable to house a plurality of balls;

one or more air blowers coupled to the ball mixing chamber, the one or more air blowers operable to generate moving air to mix the plurality of balls within the ball mixing chamber and further drive one or more randomly captured balls into a ball container and ball return tube leading into the mixing chamber;

a movement device configured to move the ball container from a first position where said balls are captured to a second position in alignment with said ball return tube such that said one or more air blowers may force said captured balls from said ball container into said ball return tube an move said ball back into the mixing chamber; and at least one of the items selected from the following group:

(a) an actuator for controlling an egress of the at least one ball from the ball return tube to the ball mixing chamber;

(b) a barcode scanner for reading a barcode carried by the at least one ball;

(c) a photo detector for detecting the presence of captured balls; and (d) a video camera for capturing a video image of the at least one ball.

16. The ball blower apparatus of claim 15, further comprising a computer programmed to control the operations of the actuator, barcode scanner, photo detector and video camera.

17. The ball blower apparatus of claim 15, further comprising transmission means for sending identified display numbers associated with said captured balls to a display.

18. The ball blower apparatus of claim 15, further comprising a mesh member for maintaining a captured ball from said ball mixing chamber in position near said barcode scanner and/or video camera.

19. The ball blower apparatus of claim 15, wherein said ball return tube circumscribes the ball mixing chamber.

20. The ball blower apparatus of claim 15, further comprising two air blowers wherein a first air blower is operable to mix balls in the ball mixing chamber and a second air blower is operable to force captured balls through a ball return tube.

21. The ball blower apparatus of claim 15, further comprising one air blower having two outputs wherein a first output is operable to mix balls in the ball mixing chamber and a second output is operable to force captured balls through a ball return tube.

22. The ball blower apparatus of claim 15, wherein a bottom surface of the ball mixing chamber is shaped in a form of an inverted pyramid.

* * * * *